United States Patent [19]

Fukuchi

[11] Patent Number: 5,040,025

[45] Date of Patent: Aug. 13, 1991

[54] TONER CARTRIDGE FOR AN IMAGE FORMING APPARATUS

[75] Inventor: Yutaka Fukuchi, Tokyo, Japan

[73] Assignee: Ricoh Company, Ltd., Tokyo, Japan

[21] Appl. No.: 586,216

[22] Filed: Sep. 21, 1990

[30] Foreign Application Priority Data

Sep. 22, 1989 [JP] Japan ..... 1-110984[U]

[51] Int. Cl.[5] ..... G03G 15/06

[52] U.S. Cl. ..... 355/260; 141/364; 141/366; 222/DIG. 1

[58] Field of Search ..... 141/346, 348, 363, 364, 141/365, 366, 383, 386; 206/527, 631; 355/215, 245, 260; 220/346; 222/DIG. 1

[56] References Cited

U.S. PATENT DOCUMENTS 4,688,023 8/1987 McGill et al. ..... 220/346 X 4,972,887 11/1990 Hacknauer et al. ..... 141/364 X

FOREIGN PATENT DOCUMENTS 0103072 4/1990 Japan ..... 355/260

*Primary Examiner*—A. T. Grimley

*Assistant Examiner*—P. J. Stanzione

*Attorney, Agent, or Firm*—Oblon, Spivak, McClelland, Maier & Neustadt

[57] ABSTRACT

A toner cartridge for use with a facsimile transceiver, printer or similar electrophotographic image forming apparatus for supplying a toner, or developer, to a developing unit of the apparatus. A first locking pawl fixes the casing and lid to each other in a condition wherein the toner has not been supplied to the developing unit, while a second locking pawl is caused into a position capable of fixing the casing and lid after the lid has been slid once relative to the casing. To supply the toner from the cartridge to the developing unit, the first pawl is pressed down to unlock the lid from the casing, and then the lid is slid along the casing. As the lid is so slid, the second pawl is brought to the condition for fixing the casing and lid. When the lid is returned along the casing after the supply of the toner, it is fixed to the casing by both of the first and second pawls.

5 Claims, 4 Drawing Sheets

TONER CARTRIDGE FOR AN IMAGE FORMING APPARATUS

BACKGROUND OF THE INVENTION

The present invention relates to a developing unit for a facsimile transceiver, printer or similar electrophotographic image forming apparatus and, more particularly, to a toner cartridge for use with such an apparatus for supplying a toner, or developer, to the developing unit.

Generally, a dry process type image forming apparatus using a toner as a developer, e.g., an electrophotographic copier has a developing unit which is supplied with a fresh toner as needed. A predominant type of system for supplying a toner to the developing unit uses a toner bottle which is filled with a toner and directly supplies it to a toner hopper included in the developing unit. This type of system, however, causes the toner to be scattered around inside the copier and thereby often disturbs the expected operations of the copier.

A toner cartridge elaborated to eliminate the above problem is disclosed in Japanese Patent Laid-Open Publication No. 93471/1984, for example. The toner cartridge taught in this Laid-Open Publication is made up of a casing having an opening, and a lid mounted on the casing to close the opening. The lid is movable along the opening of the casing to cover and uncover it. A seal is folded into two and adhered at one half thereof to the edges of the opening of the casing. A thumb piece is provided on the surface of the other half of the folded seal. The end of the other half of the seal is affixed to the outermost end of the lid. Since the lid conceals the seal, the seal is protected from damage in the event when the cartridge is transported or otherwise handled. when the lid to which the other half of the seal is affixed as mentioned above is pulled out along the opening of the casing, the seal is entirely removed from the casing to uncover the opening. The cartridge with such a configuration can be replaced with another without the toner thereof being scattered around. In addition, the operator can remove the seal from the casing by simply pulling the thumb piece which appears as the lid is moved. This insures easy and sure supply of a fresh toner.

The prior art toner cartridge stated above is successful in freeing the seal from damage in the event of transport and in preventing the toner from being scattered around in the event of toner supply. However, the drawback with such a toner cartridge is that when the lid is moved in such a manner as to remove the seal after cartridge has been emptied, the seal having already been removed from the casing hangs down from the toner cartridge and contacts an agitator. On the other hand, assume that an arrangement is made such that the used toner is collected in a toner cartridge which has supplied a fresh toner thereof and is, therefore, empty. Then, should the lid of the cartridge filled with the use or collected toner be moved, the used toner would drop from the cartridge to contaminate the interior of the apparatus. Moreover, should the dropped used toner be mixed with the fresh toner supplied from the cartridge, it would contaminate the background or a reproduction.

SUMMARY OF THE INVENTION

It is therefore an object of the present invention to provide a toner cartridge for an image forming apparatus which prevents a seal thereof from contacting an agitator.

It is another object of the present invention to provide a toner cartridge for an image forming apparatus which prevents the used toner from dropping to the inside and outside of a developing unit.

It is another object of the present invention to provide a generally improved toner cartridge for an image forming apparatus.

A toner cartridge for use with a developing unit of an image forming apparatus of the present invention comprises a casing for storing a toner therein and having an opening, a lid slidable in a predetermined direction for covering and uncovering the opening, a first locking pawl for fixing the casing and lid to each other in a condition wherein the toner has not been supplied to the developing unit, and a second locking pawl caused, after the lid has been slid once relative to the casing, into a position for fixing the casing and lid.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
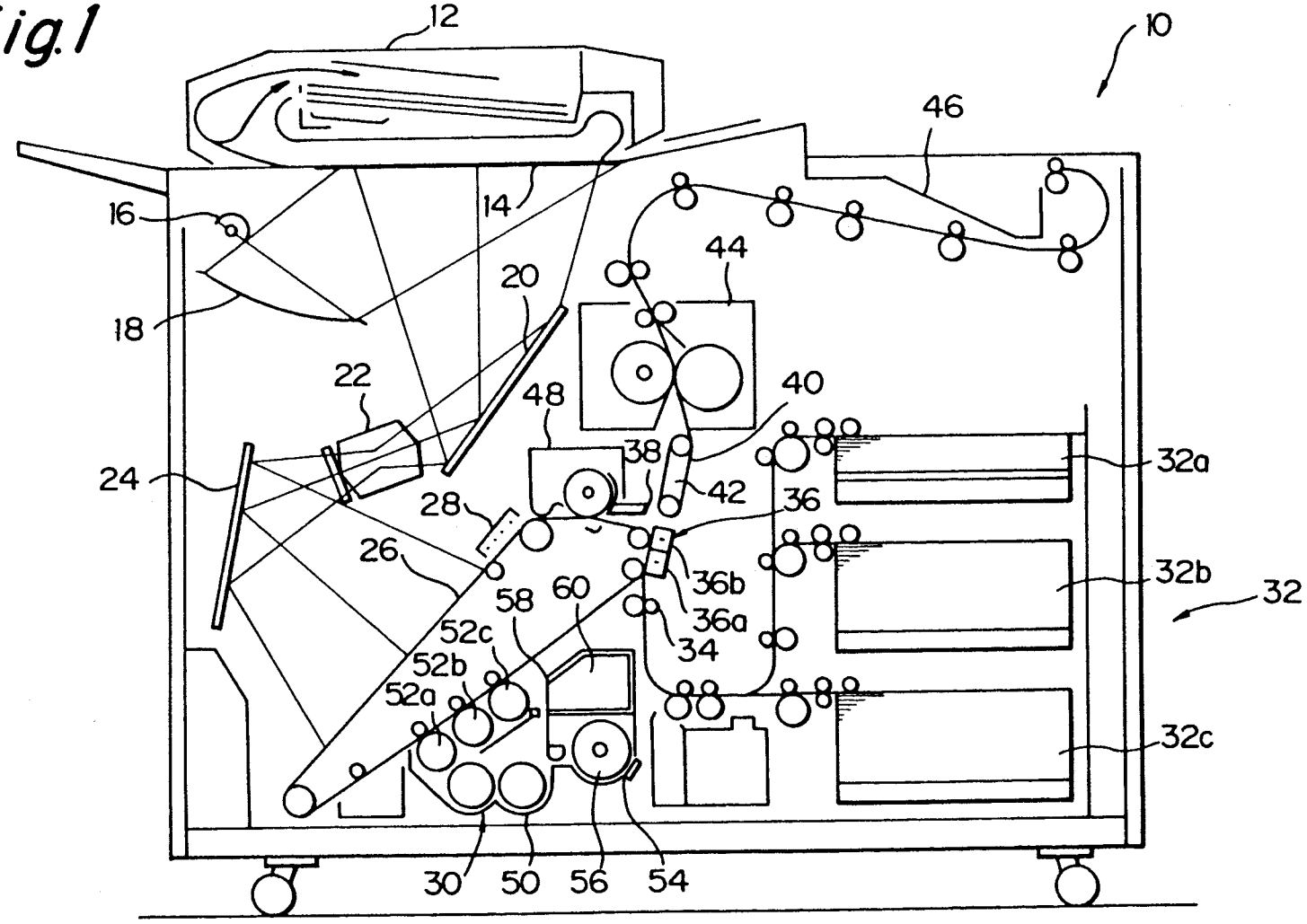
FIG. 1 is a section of an electrophotographic copier belonging to a family of image forming apparatuses and to which a toner cartridge embodying the present invention is applied.

Referring to FIG. 1 of the drawings, an image forming apparatus incorporating a toner cartridge embodying the present invention is shown and generally designated by the reference numeral 10. The image forming apparatus is implemented as an electrophotographic copier of the type using a two-component developer, although the present invention is of course practicable with an apparatus of the type using a single component developer.

As shown in FIG. 1, the copier 10 has an ADF (Automatic Document Feeder) 12 for feeding a document to a glass platen 14. A lamp 16 illuminates a document laid on the glass platen 14 by the ADF 12. The resultant imagewise reflection from the document is focused onto a photoconductive belt 26 by way of a first mirror 20, a lens 22, and a second mirror 24. The surface of the belt 26 has been uniformly charged beforehand, so that the imagewise reflection electrostatically forms a latent image thereon. A developing unit 30 develops the latent image to transform it into a toner image. A paper feed unit 32 has three paper trays **32*a*, 32*b* and 32*c* while a transfer and separation unit 36 has a transfer charger 36*a*. The transfer charger 36*a* transfers the toner image from the belt 26 to a paper sheet which is fed from any one of the paper trays 32*a* to 32*c* via a register roller 34. The paper sheet carrying the toner image thereon is separated from the belt 26 by a separation charger 36*b* also included in the transfer and separation unit 36. At the same time, the leading edge of the paper sheet is guided by a guide pawl 38 to a transport belt 40. The transport belt 40 drives the paper sheet toward a fixing unit 44 located above the belt 40, while a sucking device 42 sucks the paper sheet against the surface of the belt 40. After the fixing unit 44 has fixed the toner image on the paper sheet, the paper sheet is driven out onto a copy tray 46. A cleaning unit 48 removes toner particles which remain on the photoconductive belt 26 after the image transfer, whereby the belt 26** is prepared for another image forming cycle.

The developing unit 30 has a developer container 50 which accommodates a developer, i.e., a mixture of toner and carrier therein. While the developer is fed to and carried on developing rollers 52*a*, 52*b* and 52*c*, the toner contained in the developer is deposited on the latent image formed on the photoconductive belt 26 so as to develop the latent image. As the development is repeated, the toner existing in the container 50 is sequentially consumed with the result that the toner concentration of the developer is sequentially reduced. To feed a supplementary amount of toner to the container 50, the developing unit 30 has a toner supply chamber 54. The amount of toner present in the toner supply chamber 54 also sequentially decreases as it is fed to the container 50. When the amount of toner remaining in the chamber 54 has become smaller than a predetermined value, a piezoelectric sensor or similar sensor, not shown, disposed in the chamber 54 determines that the amount of remaining toner is short. An agitating roller 56 is located in the toner supply chamber 54. A toner cartridge 60 is removably mounted on a cartridge holding section 58 which is located above the toner supply chamber 54. When the toner remaining in the toner supply chamber 54 is short, the toner cartridge 60 will be replaced with a new toner cartridge.

Figure 2A:
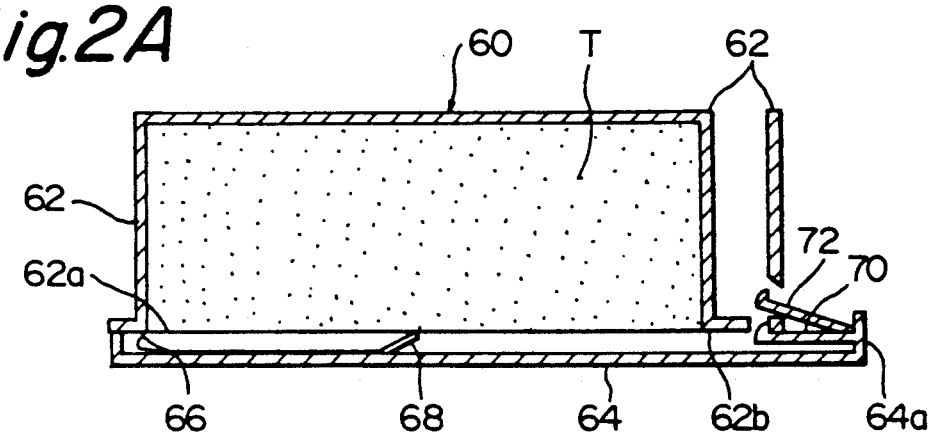
FIG. 2A is a section showing the illustrative embodiment in detail.
Figure 2B:
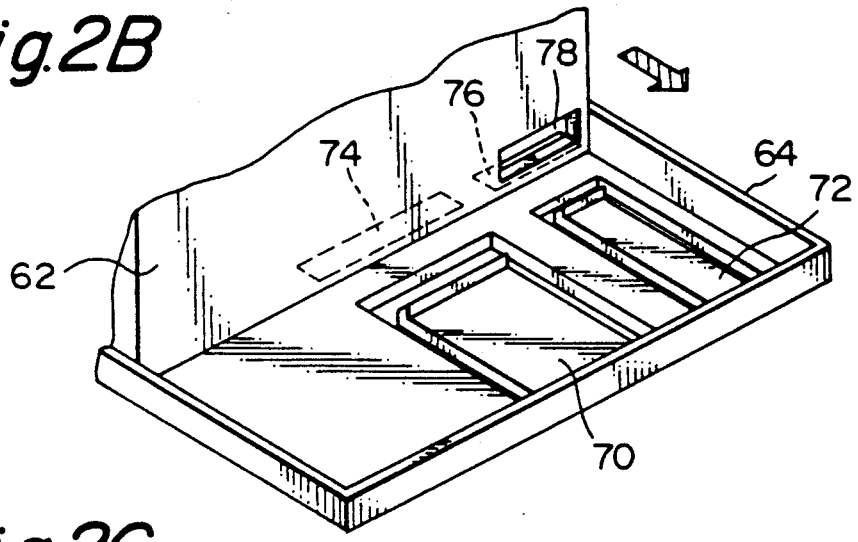
FIG. 2B is a perspective view showing locking pieces included in the embodiment.
Figure 2C:
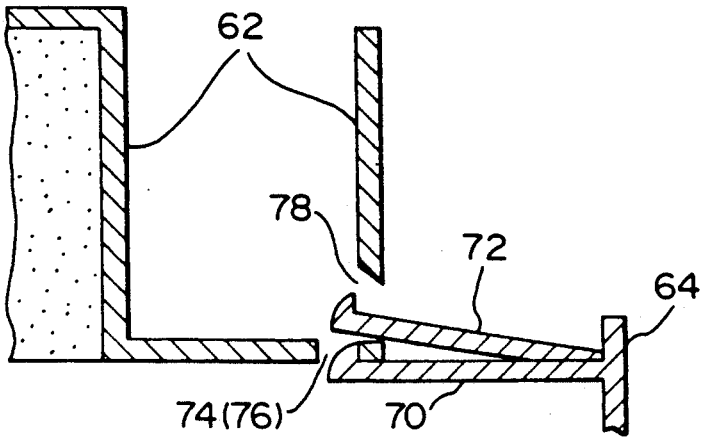
FIG. 2C is a section showing the locking pieces.

FIG. 2A shows the toner cartridge 60 embodying the present invention in detail. As shown, the cartridge 60 is made up of a casing 62 having an opening 62*a* at the bottom thereof, and a closure member or lid 64 movable along the opening 62*a* in the lengthwise direction of the cartridge 60. The casing 62 is filled with a toner T and has its opening 62*a* hermetically sealed by a flat seal member 66. A thumb piece 68 is provided on the lid 64 for removing the seal member 66, as will be described. The seal member 66 is affixed at one end to one end 62*b* of the casing 62 and at the other end to one end 64*a* of the lid 64, while being adhered to the edges of the opening 62*a* by heat sealing or similar technology. A first and a second locking piece or pawl 70 and 72, respectively, each is made of an elastic material and provided on the lid 64. As shown in FIGS. 2B and 2C, the second pawl 72 is longer than the first pawl 70. Holes 74 and 76 are formed through the casing 62 to mate with the pawls 70 and 72, respectively, and to thereby fix the lid 64 in place. A window 78 is also formed through the casing 62 for receiving the second pawl 72. As shown in FIG. 2C, before the cartridge 60 is used, i.e., before the lid 64 is slid along the casing 62, the first locking pawl 70 is received in the hole 74 while the second locking piece of pawl 72 is received in the window 78 in an elastically deformed position.

The placement of the cartridge 60 will be described with reference to FIGS. 3A to 3C and 4A to 4C.

Figure 3A:
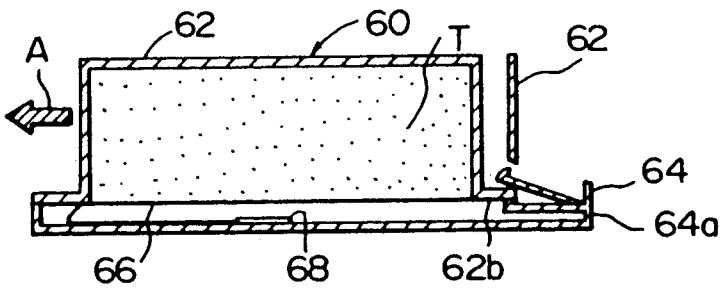
FIGS. 3A to 3C and 4A to 4B are views each showing the embodiment in a particular condition.

After the used toner cartridge has been pulled out of the cartridge holding section 58, a new toner cartridge 60 is inserted into the cartridge holding section 58 as indicated by an arrow A in FIG. 3A. Thereafter, the first locking pawl 70 is pressed down, i.e., moved in a direction indicated by an arrow X in FIG. 4A so as to release the pawl 70 from the hole 74 of the casing 62. Then, the lid 64 is pulled out in a direction indicated by an arrow Y, FIGS. 3B and 4B. At this instant, since the second locking pawl 72 is received in the window 78 in an elastically deformed position with the leading edge thereof simply left free, it is readily pulled out of the window 78 with no resistance acting thereon. Specifically, as shown in FIG. 4B, immediately after the lid 64 has begun to be pulled out, the second pawl 72 is released from the window 78 and restored to the unstressed or straight position like the first pawl 70.

Figure 3B:
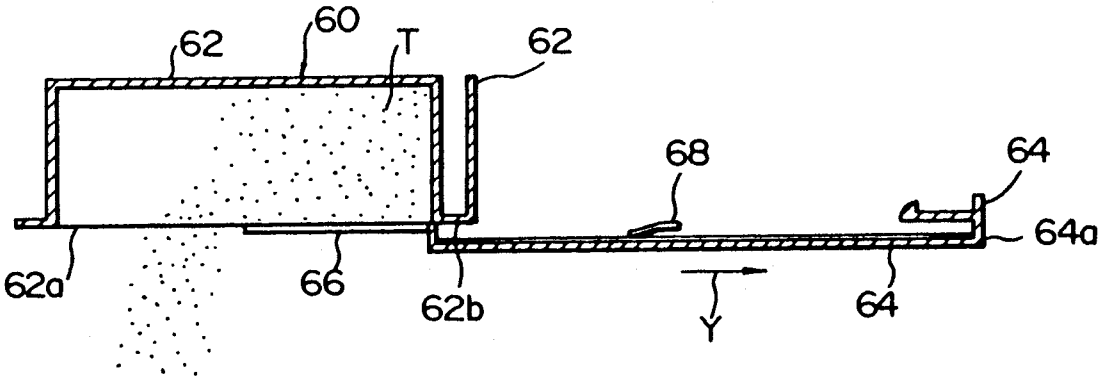
Figure 3C:
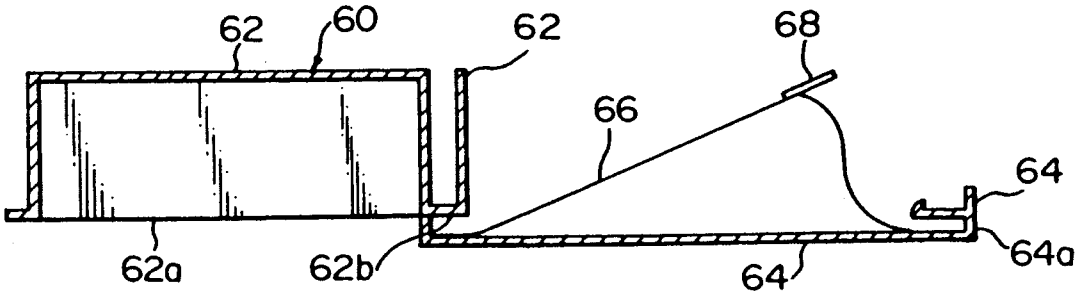
Figure 4A:
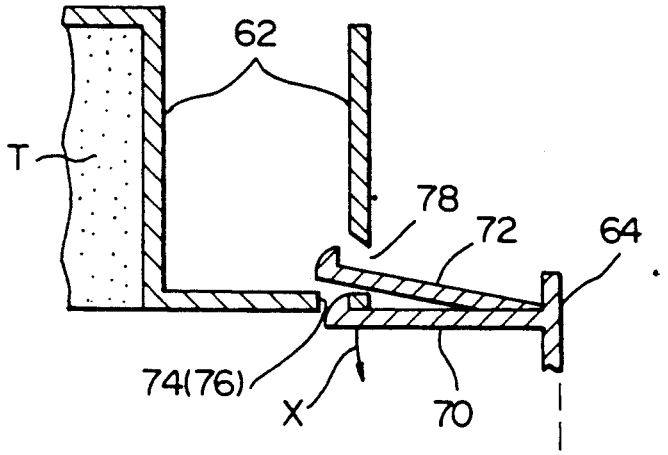
Figure 4B:
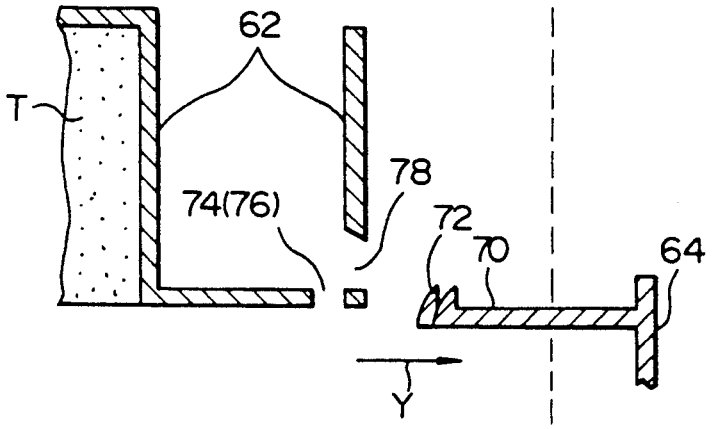
Figure 4C:
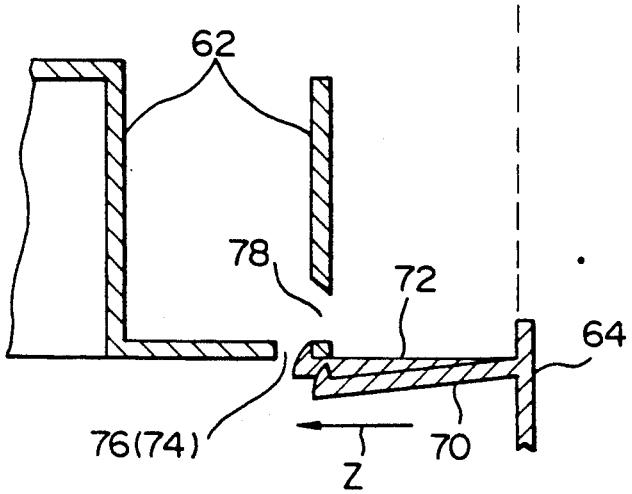

As shown in FIG. 3B, when the lid 64 is fully pulled out of the casing 62, the seal member 66 has been removed by one half from the opening 62*a* of the casing 62. Subsequently, as shown In FIG. 3C, the thumb piece 68 is pulled out to fully remove the seal member 66 from the opening 62*a* with the result that the toner T in the casing 62 is dropped at once. Thereafter, as the lid 64 is pushed into the cartridge holding section 58 along the casing 62, the pawls 70 and 72 are respectively mated with the holes 74 and 76 of the casing 62. In this condition, the lid 64 is affixed to the toner casing 62 at two points thereof. In the illustrative embodiment, the pawl 72 has a greater length than the pawl 70, as stated earlier. Hence, as shown in FIG. 4C, the longer pawl 72 mates with the hole 76 before the lid 64 is fully inserted to the deepest position in the cartridge holding section 58, i.e., before the shorter pawl 70 mates with the hole 74. Stated another way, the lid 64 is fixed to the casing 62 before the lid 64 is fully returned to the deepest position.

In summary, the illustrative embodiment achieves various unprecedented advantages, as enumerated below.

(1) A lid and a casing of a toner cartridge are fixed to each other by a plurality of locking pieces or pawls. This prevents the operator from inadvertently letting the toner of a used toner cartridge to fall, otherwise occurring whent the operator pulls out a lid by pressing down one pawl or without noticing that the leading edge of a pawl is not surely mated with a hole.

(2) Despite the plurality of locking pawls, the lid is easy to pull out. This is because a first locking pawl fixes the lid in place relative to the casing before the supply of toner while a second locking pawl fixes the lid to the casing after the former has been slid once relative to the latter.

(3) The plurality of locking pawls, two pawls in the illustrative embodiment, are different in length from each other, so that the pawls mate with associated holes over a long distance. Specifically, while a lid with a single locking pawl would have to be surely returned to a predetermined position where the pawl mates with a hole, the lid of the illustrative embodiment needs only to be returned to a position where one of the plurality of locking pawls mates with its associated hole. This is successful in broadening the range over which the lid and the casing can be fixed to each other and, therefore, in allowing them to be fixed more positively.

Various modifications will become possible for those skilled in the art after receiving the teachings of the present disclosure without departing from the scope thereof. For example, the first and second locking pawls each may be constituted by a plurality of pawls. The pawls may be implemented as metallic leaf springs in order to free them from plastic deformation and malfunction even when the cartridge is stored over a long period of time.

What is claimed is:

1. A toner cartridge for use with a developing unit of an image forming apparatus, comprising:

a casing for storing a toner therein and having an opening;

a lid slidable in a predetermined direction for covering and uncovering said opening;

a first locking pawl for fixing said casing and said lid to each other in a condition wherein the toner has not been supplied to the developing unit; and a second locking pawl caused, after said lid has been slid once relative to said casing, into a position for fixing said casing and said lid.

2. A toner cartridge as claimed in claim 1, wherein said first and second locking pawls are provide on said lid.

3. A toner cartridge as claimed in claim 2, wherein said first and second locking pawls mate respectively with a first and a second holes which are formed through said casing at leading edges of said first and second locking pawls.

4. A toner cartridges as claimed in claim 3, wherein said first and second locking pawls each has a particular length.

5. A toner cartridge as claimed in claim 4, wherein said first locking pawl is shorter than said second locking pawl.

* * * * *